US007494199B2

(12) United States Patent
Aoki

(10) Patent No.: US 7,494,199 B2
(45) Date of Patent: Feb. 24, 2009

(54) HEAD CONTROL DEVICE AND IMAGE RECORDING APPARATUS

(75) Inventor: Sumiaki Aoki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 69 days.

(21) Appl. No.: 10/513,216

(22) PCT Filed: Jun. 20, 2003

(86) PCT No.: PCT/JP03/07882

§ 371 (c)(1),
(2), (4) Date: Nov. 2, 2004

(87) PCT Pub. No.: WO04/000560

PCT Pub. Date: Dec. 31, 2003

(65) Prior Publication Data

US 2005/0237350 A1 Oct. 27, 2005

(30) Foreign Application Priority Data

Jun. 24, 2002 (JP) ..... 2002-182284

(51) Int. Cl.
*B41J 29/38* (2006.01)
*B41J 2/45* (2006.01)

(52) U.S. Cl. ..... 347/9; 347/11; 347/72

(58) Field of Classification Search ..... 347/9, 347/11
See application file for complete search history.

(56) References Cited

U.S. PATENT DOCUMENTS 5,781,203 A * 7/1998 Uriu et al. ..... 347/9
6,247,776 B1 * 6/2001 Usui et al. ..... 347/11
6,270,179 B1 8/2001 Nou ..... 347/10
6,357,846 B1 * 3/2002 Kitahara ..... 347/10
6,371,587 B1 * 4/2002 Chang ..... 347/11
6,431,675 B1 * 8/2002 Chang ..... 347/10
6,764,152 B2 * 7/2004 Umeda et al. ..... 347/9
2004/0207671 A1 * 10/2004 Kusunoki et al. ..... 347/10

FOREIGN PATENT DOCUMENTS

JP 61-59911 3/1986
JP 2-51734 2/1990
JP 4-310748 11/1992
JP 6-71882 3/1994
JP 9-234865 9/1997

(Continued)

OTHER PUBLICATIONS

Aug. 25, 2006 Chinese official action and English translation.

*Primary Examiner*—Luu Matthew
*Assistant Examiner*—Shelby Fidler
(74) *Attorney, Agent, or Firm*—Cooper & Dunham, LLP

(57) ABSTRACT

There is provided a head control device able to re-charge an electromechanical transducing element with a driving pulse without requiring an additional re-charging time period in a recording period. The driving signal includes a plurality of driving pulses, and in each recording period, at least one driving pulse includes a portion varying from a discharging level to a medium level to charge the piezoelectric element to eject a liquid droplet, and a subsequent portion varying from the medium level to a target level to re-charge the piezoelectric element to the target level.

10 Claims, 12 Drawing Sheets

FOREIGN PATENT DOCUMENTS

| | | | | |
|---|---|---|---|---|
| JP | 2000-43245 | | | 2/2000 |
| JP | 2001-10035 | | | 1/2001 |
| JP | 2001-113695 | | | 4/2001 |
| JP | 2002-1948 | | | 1/2002 |
| JP | 2003094639 | A | * | 4/2003 |
| JP | 2003118116 | A | * | 4/2003 |
| JP | 2003237066 | A | * | 8/2003 |

* cited by examiner

RECORDING PERIOD
P1
P2
P3
P31

Vcom

Vh11
Vb

Vh10
Vb

Vh01
Vb

Vh00
Vb

M3N

M2N

M1N

M0N
T0
T1
T2
T3
T4

HEAD CONTROL DEVICE AND IMAGE RECORDING APPARATUS

TECHNICAL FIELD

The present invention relates to a head control device and an image recording apparatus, more particularly, to a head control device that controls a liquid droplet ejection head including an electromechanical transducing element, and an image recording apparatus having the head control device.

BACKGROUND ART

An inkjet image forming apparatus, such as a printer, a facsimile machine, a copier machine, or a plotter, comprises an inkjet head to eject ink droplets to record images. The inkjet head has nozzles through which ink droplets are ejected, ink flowing paths usually including chambers for applying pressure to the ink therein and in communication with the corresponding nozzles, an ink feeding path, and so on, and portions for creating and applying pressure to the ink in the flowing paths to eject ink droplets. There are also devices for ejecting other kinds of liquid droplets, for example, those ejecting droplets of liquid resists, and those ejecting droplets of DNA samples.

In an inkjet head, various methods are employed to apply pressure to the ink in an ink flowing path so as to form droplets of ink and eject them. The following methods are well known in the related art.

Japanese Unexamined Patent Publication No. 2-51734 discloses an inkjet head in which an electromechanical transducer, for example, a piezoelectric element (a piezoelectric crystal), is used as a vibrating plate to form a vibrating wall of a chamber to apply pressure to the ink (the pressure application chamber). When the crystal receives a charge, the vibrating wall deforms and vibrates, therefore changing the volume of the ink chamber and forcing some of the ink in the chamber out through the nozzle. This is the so-called "piezoelectric inkjet head".

In addition, Japanese Unexamined Patent Publication No. 61-59911 discloses another inkjet head in which a resistor is used in each pressure application chamber to create heat; this heat vaporizes the ink in the chamber and creates a bubble. As the bubble expands, some of the ink in the chamber is pushed out by the pressure. This is the so-called "thermal inkjet head".

Further, Japan Unexamined Patent Publication No. 6-71882 discloses still another inkjet head in which an electrode is placed facing a vibrating plate that forms a wall of each pressure application chamber. Because of the electrostatic force created between the electrode and the vibrating plate, the vibrating plate deforms and vibrates, therefore changing the volume of the chamber and forcing some of the ink in the chamber out through the nozzle. This is the so-called "electrostatic inkjet head".

The inkjet heads mentioned above exhibit two kinds of methods of forming ink droplets. In one of them, a vibrating plate is pushed inward relative to the pressure application chamber, decreasing the volume of the chamber, and forcing some of the ink out. In the other method, a vibrating plate is pulled outward relative to the chamber and thus expanding the volume thereof; then the vibrating plate deforms so as to recover from the expanded shape to its original shape, and therefore, forces some of the ink out.

In an inkjet head using the second method (pulling the vibrating plate), as an initial state, a bias voltage is applied to the piezoelectric element to charge the element. Then the piezoelectric element discharges (releases the stored charge), leading to contraction of the piezoelectric element. Accordingly, the volume of the chamber increases, and this pulls more ink into the chamber from outside, for example, the ink feeding channel. Then, a driving signal is applied to the piezoelectric element to charge the element rapidly, causing rapid expansion of the element, and this rapidly decreases the volume of the chamber and forces some ink droplets out through the nozzle.

Next, with reference to FIG. 12 and FIGS. 13A through 13H, explanations are made of the operations of a head control device for controlling an inkjet head that employs the second method to form three kinds of ink droplets (referred to as "dots" below) by using the d33 mode of a piezoelectric crystal.

FIG. 12 shows a head control device of the related art.

In the head control device shown in FIG. 12, a driving signal Vcom including a number of driving pulses (shown in FIG. 13) is output from a driving signal generator 101, and is input to a piezoelectric element 103 through a switch 102. The switch 102 is switched ON or switched OFF depending on the output signals of a decoder 104 through a level shifter 105.

The decoder 104 includes gate circuits 110 through 112, which receive recording data signals L0, L1, L2 stored in a not-shown memory and gate signals M0, M1, M2, respectively, whose levels are controlled within a recording period so as to select the desired recording data, and an OR circuit 113 that sends the signals from the gate circuits 110 through 112 to the level shifter 105.

Here, it is assumed that a small dot is to be formed when L0=1, a medium dot is to be formed when L1=1, and a large dot is to be formed when L2=1; further, when L0=L1=L2=0, the piezoelectric element will not operate and no dots are formed.

FIGS. 13A through 13H show timing charts of signals in the head control device in FIG. 12 when operated to form the above dots. Specifically, FIGS. 13A through 13H show waveforms of the driving signal Vcom, signals selected from the driving signal Vcom and applied to the piezoelectric element, and the gate signals M0, M1, M2.

When a large dot is to be formed, that is, when L2=1, by setting M2=1 in the period from the time T10 to the time T11 as shown in FIG. 13F, a driving pulse for forming a large dot as shown in FIG. 13B is extracted from the driving signal Vcom and applied to the piezoelectric element 103.

In addition, when a medium dot is to be formed, that is, when L1=1, by setting M1=1 in the period from the time T11 to the time T12 as shown in FIG. 13G, a driving pulse for forming a medium dot as shown in FIG. 13C is extracted from the pulses in the driving signal Vcom and applied to the piezoelectric element 103.

When a small dot is to be formed, that is, when L0=1, by setting M0=1 in the period from the time T12 to the time T13 as shown in FIG. 13H, a driving pulse for forming a small dot as shown in FIG. 13D is extracted from the pulses in the driving signal Vcom and applied to the piezoelectric element 103.

In this way, by generating a common driving signal Vcom including driving pulses for forming various kinds of dots, selecting appropriate driving pulses from the driving signal Vcom according to the predetermined gate signals and recording data signals to switch ON or switch OFF the appropriate channel, and applying the selected driving pulses (waveform) to the piezoelectric element, ink droplets of different sizes, in other words, dots of different grade levels, can be formed with a single driving signal Vcom.

In the above process, before a piezoelectric element is operated, it is preferable to apply a bias voltage to the piezoelectric element in advance to keep the piezoelectric element in a charged state (expanded condition). As described above, this charged state is the initial condition of the piezoelectric element when it is operated to form ink droplets. For example, this treatment is necessary for a piezoelectric element not required to form a dot in the present recording period. Additionally, even for a piezoelectric element that has been operated to form a dot in the present recording period, it is still preferable to keep the piezoelectric element in a charged state before the next driving pulse is applied.

However, in a head control device having the above configuration, for example, considering a piezoelectric element not forming a dot in the present recording period, even then a bias voltage is applied in the preceding recording period and the piezoelectric element is kept in a charged state by that bias voltage. Because of natural discharge of the piezoelectric element, the potential of the element decreases in the present recording period.

Due to this, when a driving pulse for ejecting an ink droplet is applied in a following recording period, because the potential right before ejecting is too low, it is difficult to form an ink droplet containing a desired amount of ink.

In the same way, for a piezoelectric element that has been operated to form a dot in the preceding recording period, in the duration in which a driving voltage is not applied to the piezoelectric element, the natural discharge occurs. If this duration before a driving voltage is applied is long, the potential of the piezoelectric element decreases noticeably because of the natural discharge; consequently, even if a desired driving pulse for ejecting a desired ink droplet is selected and applied in the present recording period, since the potential right before ejecting is too low, it is difficult to form an ink droplet containing a desired amount of ink.

As a solution to this problem, Japanese Unexamined Patent Publication No. 2001-10035 discloses an inkjet recording apparatus in which, at a specified timing in each recording period, a bias level is selected from the driving signal to re-charge the piezoelectric element to the bias level.

However, in the above inkjet recording apparatus, a time interval related to the re-charging level has to be allocated in the driving signal. The length of the time interval is determined taking the reaction time of a switch into consideration, that is, the duration from the time when a switching command is issued to the time when the switch is actually switched ON or switched OFF. Usually, the time interval should be set relatively long.

However, in order to increase image formation speed, it is desirable to make the ink droplet ejection period short, so it is difficult to secure an additional re-charging time period that is irrelevant to ink droplet ejection operation. Further, in order to increase the number of the grade levels to improve image quality, it is required to allocate more pulses in the driving signal, and this also makes it difficult to secure the additional re-charging time period in the driving signal.

SUMMARY

In an aspect of the present disclosure, a head control device is provided with means to re-charge an electromechanical transducing element with a driving pulse without providing an additional re-charging time period in a recording period, and an image recording apparatus having the head control device.

In an exemplary embodiment of the present disclosure, there is provided a head control device that applies a driving signal to an electromechanical transducing element to change a shape of the electromechanical transducing element to change a volume of a liquid droplet ejection chamber filled with a liquid to eject a liquid droplet through a nozzle in communication with the liquid droplet ejection chamber, comprising a head driving unit that generates the driving signal including a plurality of cycles of a plurality of driving pulses, selects and applies one of the driving pulses to the electromechanical transducing element to change the shape of the electromechanical transducing element for ejecting the liquid droplet, each driving pulse having a first portion varying from a first level to a second level for changing the electromechanical transducing element from a first shape to a second shape, and a second portion varying from the second level to the first level for changing the electromechanical transducing element from the second shape back to the first shape to eject the liquid droplet, wherein in at least one driving pulse in each cycle, the second portion includes a third portion varying from the second level to a third level for changing the shape of the electromechanical transducing element to eject the liquid droplet, and a fourth portion subsequent to the second portion varying from the third level to the first level for changing the shape of the electromechanical transducing element back to the first shape.

Preferably, the first portion discharges the electromechanical transducing element from a first potential equivalent to the first level to a second potential equivalent to the second level, the second portion charges the electromechanical transducing element to the first potential to eject the liquid droplet, the third portion charges the electromechanical transducing element to a third potential equivalent to the third level to eject the liquid droplet, and the fourth portion re-charges the electromechanical transducing element to the first potential.

According to the above aspect of the present invention, the electromechanical transducing element is re-charged by a portion (the fourth portion) of the driving pulse varying from a medium value (the third level) to the first level, but not by a signal at the first level, thus re-charging of the electromechanical transducing element can be started earlier, and consequently, the duration of re-charging becomes short.

Further, since the fourth portion is applied to the electromechanical transducing element after the third portion induces liquid droplet ejection, the re-charging operation does not influence liquid droplet ejection, and this reduces the possibility of mistaken ink ejection due to re-charging.

Furthermore, since the fourth portion is included in one cycle of the driving signal, it is not necessary to provide an additional time interval to allocate the signal for re-charging, so it is possible to increase the speed of image formation and improve image quality.

In another aspect of the present invention, there is provided an image recording apparatus comprising a liquid droplet ejection head including a plurality of liquid droplet ejection chambers each filled with a liquid and communicating with a nozzle, and a plurality of electromechanical transducing elements in correspondence with the liquid droplet ejection chambers; and a head control device that applies a driving signal to the electromechanical transducing elements to change shapes of the electromechanical transducing elements to change volumes of the corresponding liquid droplet ejection chambers for ejecting liquid droplets through the corresponding nozzles to record an image, the head control device comprising a head driving unit that generates the driving signal including a plurality of cycles of a plurality of driving pulses, and selects and applies one of the driving pulses to one of the electromechanical transducing elements to change the shape of the electromechanical transducing element for ejecting the liquid droplet, each of the driving pulses having a first portion varying from a first level to a second level for changing the electromechanical transducing element from a first shape to a second shape, and a second portion varying from the second level to the first level for changing the electromechanical transducing element from the second shape back to the first shape to eject the liquid droplet, wherein in at least one driving pulse in each cycle, the second portion includes a third portion varying from the second level to a third level for changing the shape of the electromechanical transducing element to eject the liquid droplet, and a fourth portion subsequent to the second portion varying from the third level to the first level for changing the shape of the electromechanical transducing element back to the first shape.

Preferably, the first portion discharges the electromechanical transducing element from a first potential equivalent to the first level to a second potential equivalent to the second level, the second portion charges the electromechanical transducing element to the first potential to eject the liquid droplet, the third portion charges the electromechanical transducing element to a third potential equivalent to the third level to eject the liquid droplet, and the fourth portion re-charges the electromechanical transducing element to the first potential.

Preferably, the head driving unit selects the fourth portion of said at least driving pulse in each cycle to re-charge the plurality of electromechanical transducing elements at the same time.

BRIEF DESCRIPTION OF THE DRAWINGS

These and other objects, features, and advantages of the present invention will become more apparent from the following detailed description of preferred embodiments given with reference to the accompanying drawings, in which.

BEST MODE FOR CARRYING OUT THE INVENTION

Below, preferred embodiments of the present invention will be explained with reference to the accompanying drawings.

Figure 1:
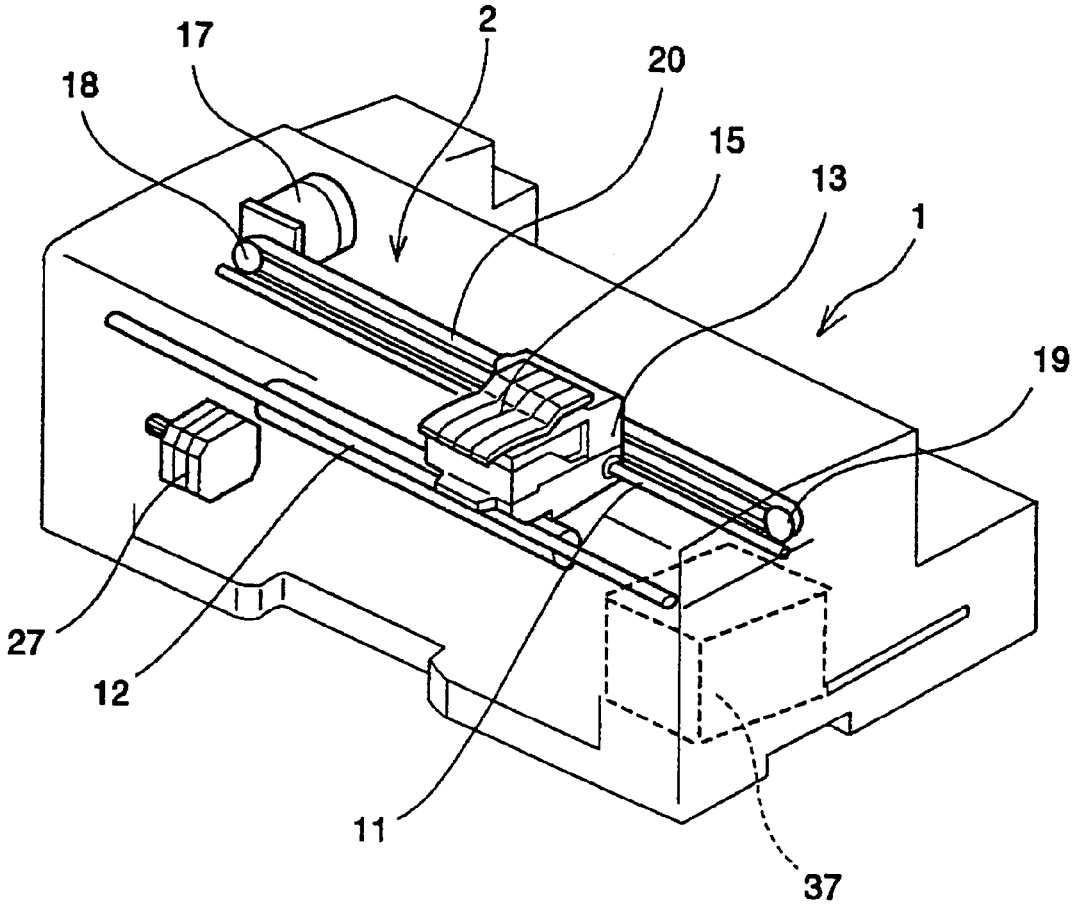
FIG. 1 is a perspective view of the machinery of an inkjet recording apparatus as an example of an image recording apparatus according to an embodiment of the present invention.
Figure 2:
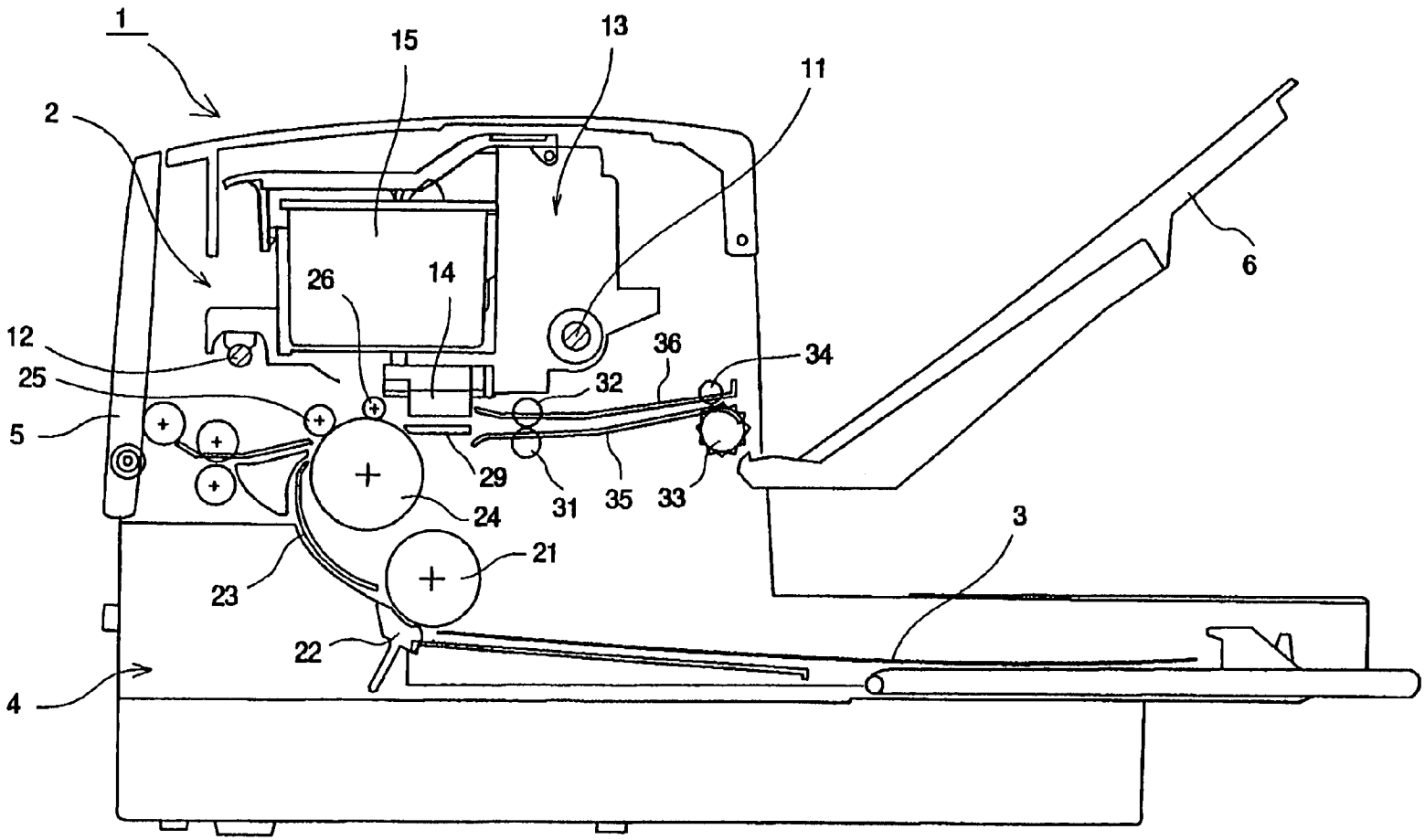
FIG. 2 is a cross-sectional side view of the machinery of the inkjet recording apparatus of the present embodiment.

FIG. 1 shows a perspective view of an inkjet recording apparatus as an example of an image recording apparatus according to an embodiment of the present invention. FIG. 2 is a cross-sectional side view of the inkjet recording apparatus.

The inkjet recording apparatus shown in FIG. 1 and FIG. 2 has a main body 1 and printing machinery 2 accommodated in the main body 1. The printing machinery 2 has a recording head including a carriage 13 movable along a main scan direction, an inkjet head 14 attached to the carriage 13, and an ink cartridge 15. The printing machinery 2 takes in paper 3 fed from a paper feed cassette 4 or a manual feed tray 5, then records a desired image on the paper 3, and then delivers the paper 3 to a paper delivery tray 6 attached to the rear side of the apparatus.

In the printing machinery 2, a first guide rod 11 lays across two not-illustrated side boards, serving as a guide member of the carriage 13, and by the first guide rod 11 and a secondary guide rod 12, the carriage 13 is maintained to be able to freely slide in the main scan direction (the axial direction along the guide rod 11). The inkjet head 14 has a number of single color inkjet heads to eject ink droplets of yellow (Y), cyan (C), magenta (M), black (B) or other colors. The inkjet head 14 is attached to the carriage 13 extending downward along the direction of ejecting the ink droplets.

The ink cartridge 15 has a number of ink tanks for storing and supplying ink of the above respective colors to corresponding single color inkjet heads of the inkjet head 14. The ink cartridge 15 is attached to the upper side of the carriage 13, and each ink tank in the ink cartridge 15 is exchangeable when ink therein is running out.

The ink cartridge 15 has an air hole on its upper side for communication with the atmosphere, a feeding hole on its lower side for supplying ink to the inkjet head 14, and a porous material of which the inside is filled with ink. Due to the capillary force of the porous material, the ink to be supplied to the inkjet head 14 is maintained at a slightly negative pressure. From the ink cartridge 15, ink is fed to the inkjet head 14.

The first guide rod 11 is inserted into the rear side of the carriage 13 (downstream side along the paper conveyance direction) while keeping the carriage 13 freely slidable along the first guide rod 11. The front side of the carriage 13 (upstream side along the paper conveyance direction) is firmly held by the secondary guide rod 12 while keeping the carriage 13 freely slidable along the secondary guide rod 12. In order to drive the carriage 13 to scan along the main scan direction, a timing belt 20 is wound between a driving pulley 18 driven by a main scan motor 17 and a driven pulley 19, and is fixed to the carriage 13; due to the forward an backward rotation of the main scan motor 17, the carriage 13 is moved back and forth.

Note that as an example, the inkjet head 14 is described to have a number of single color inkjet heads. The inkjet head 14 may also be configured to have a single head having a number of nozzles ejecting ink droplets of different colors. Further, as described below, the inkjet head 14 is a piezoelectric head, in which at least part of the side wall of a pressure application chamber is formed by a vibrating plate, and this vibrating plate is deformed and vibrated by a piezoelectric element.

On the other hand, in order to convey paper 3 from the paper feed cassette 4 to the position below the inkjet head 14, there are arranged a paper feeding roller 21 and a friction pad 22 for separating and feeding paper 3 from the paper feed cassette 4, a guide member 23 for guiding the paper 3, a conveyance roller 24 for reversing the paper 3 for further conveyance, a roller 25 pressed against the surface of the conveyance roller 24, and a roller 26 for limiting the angle at which paper 3 is sent out.

The conveyance roller 24 is driven to rotate by a sub scan motor 27 via a series of gears.

A paper guide member 29 is provided corresponding to the movement range of the carriage 13 along the main scan direction to guide the paper 3 sent out from the conveyance roller 24 to the position below the inkjet head 14. On the downstream side along the paper conveyance direction, a roller 31 and a spur 32 are arranged to send out the paper 3 in the delivery direction. Further, a delivery roller 33, a spur 34, and guide members 35 and 36 forming a paper delivery path are provided to send paper 3 to the paper delivery tray 6.

When recording an image on the paper 3, while the carriage 13 is being moved, the inkjet head 14 is driven to eject ink droplets to the paper 3 at rest according to an image signal to record one line; then the paper 3 is moved by one line so as to record the next line. When a recording completion signal, or a signal indicating that the present position of the carriage 13 is at the end of the recording region of the paper 3 is received, the above recording operation is ended and the paper 3 is delivered.

At a position out of the recording region along the first guide rod 11, a recovery unit 37 is arranged in order to resolve ink ejection problems of the inkjet head 14. The recovery device 37 has a cap, an absorber, and a cleaner. At standby, the carriage 13 is moved to the recovery unit 37, where the recovery unit 37 caps the inject head 14 to keep its nozzle wet to prevent ink ejection problems. In addition, during recording operations, an additional amount of ink is ejected from the inkjet head 14 not for recording but for purging the inkjet head 14, keeping the viscosity coefficients at all the nozzles constant to maintain constant ink ejection performance.

When ink ejection trouble occurs, the nozzle of the inkjet head 14 is sealed by the cap of the recovery unit 37, and through a tube, the absorber takes suction on and evacuates ink, and bubbles in the ink together, from the nozzle, and the cleaner cleans ink and other dust adhering to the nozzle to allow the inkjet head 14 to recover from the ink ejection trouble. The ink drawn out by the absorber is exhausted to a tank for collecting waste ink, and is stored in an ink absorbing material.

Figure 3:
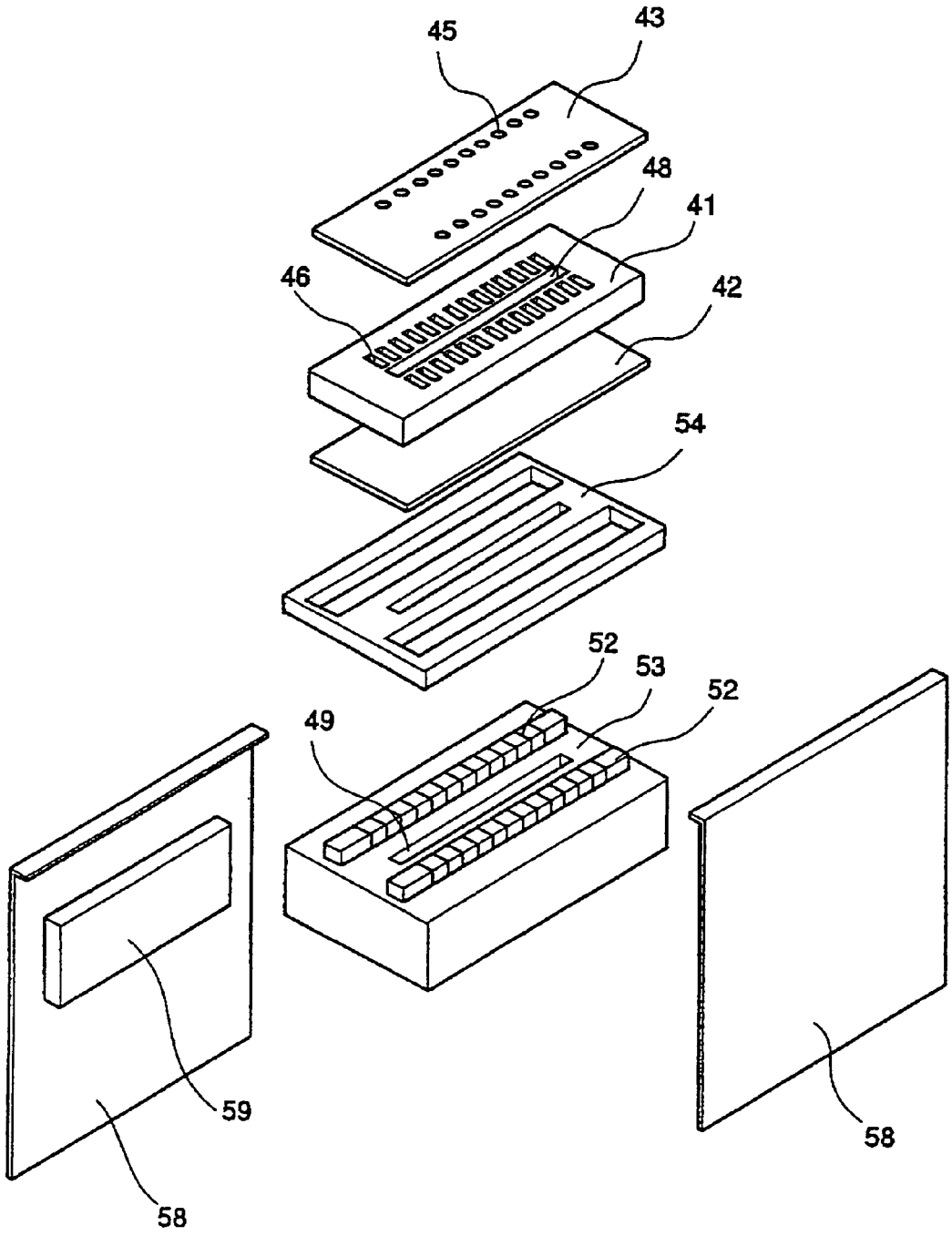
FIG. 3 is an exploded perspective view of an example of an inkjet head included in the inkjet recording apparatus of the present embodiment.
Figure 4:
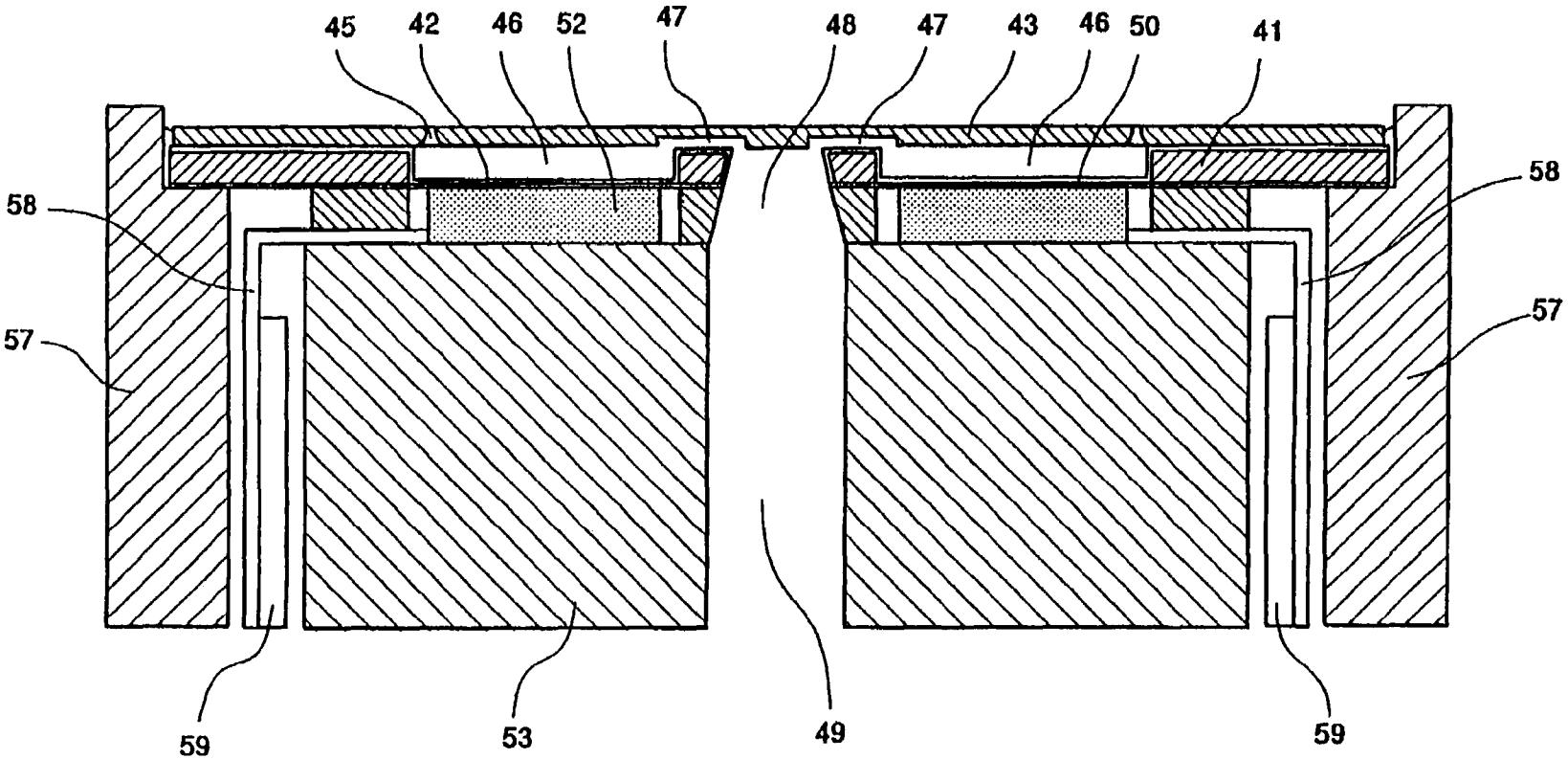
FIG. 4 is a cross-sectional view of a portion containing liquid in the recording head of the present embodiment along the long edge of the portion.
Figure 5:
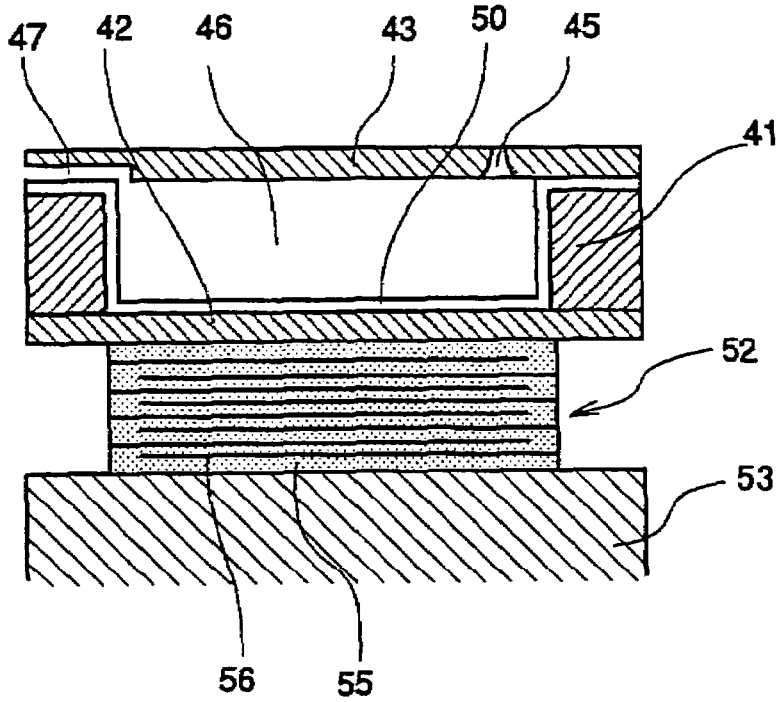
FIG. 5 is an enlarged view of the portion containing liquid in FIG. 4.
Figure 6:
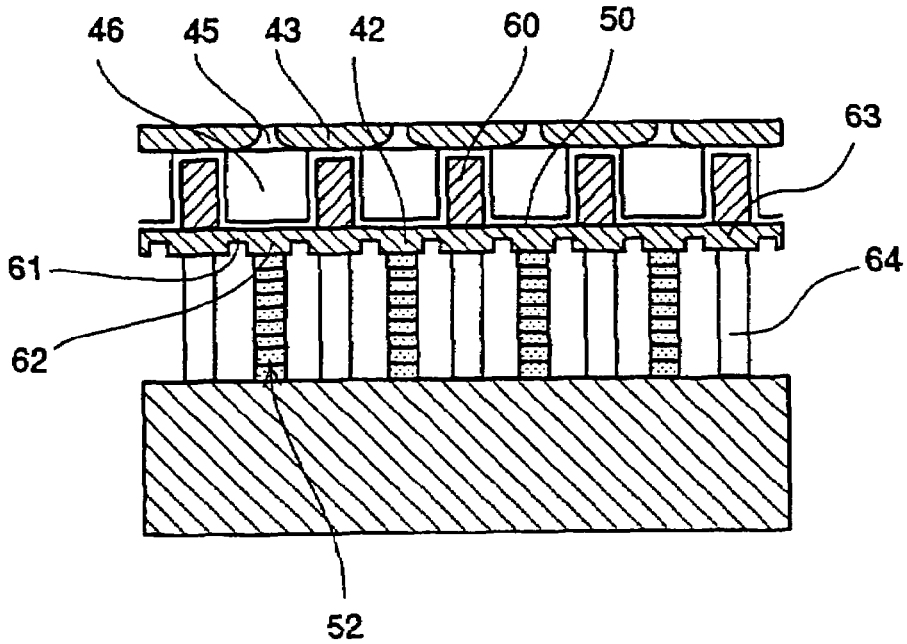
FIG. 6 is a cross-sectional view of the portion in FIG. 4 along its short edge.

Next, the inkjet head 14 of the inkjet recording apparatus is explained in detail with reference to FIG. 3 through FIG. 6. FIG. 3 is an exploded perspective view showing a configuration of the inkjet head 14; FIG. 4 is a cross-sectional view of a portion of the inkjet head 14 containing ink along its long edge; FIG. 5 is an enlarged view of the core portion of the portion shown in FIG. 4; FIG. 6 is a cross-sectional view of the portion in FIG. 4 along its short edge.

As shown in the above figures, the inkjet head 14 comprises a substrate 41 formed from single crystal silicon, a vibration plate 42 joined with the lower side of the substrate 41, and a nozzle plate 43 formed with many nozzles 45 and joined with the upper side of the substrate 41.

In FIG. 4 through FIG. 6, the reference 46 represents a pressure application chamber formed by the substrate 41, the vibration plate 42, and the nozzle plate 43. The pressure application chambers 46 are in communication with the nozzles 45.

The reference 48 represents a liquid room that feeds ink to the pressure application chamber 46 through an ink feeding channel 47 acting as a liquid resistor.

The side walls of the pressure application chamber 46, the ink feeding channel 47, and the liquid room 48 act as the side surfaces of the substrate 41 and are in contact with ink, and on these side walls, a film 50 is formed from an organic resin tolerable to liquid erosion.

As shown in FIG. 3 (also referring to FIG. 4), two lines of stacked piezoelectric elements 52 are provided at positions each corresponding to a pressure application chamber 46. The piezoelectric elements 52 are joined with the lower side of the vibration plate 42 and fixed on a base 53. A spacer 54 is arranged around the two lines of stacked piezoelectric elements 52 and joined with the base 53.

As shown in FIG. 5, each piezoelectric element 52 is formed by alternately stacking a piezoelectric film 55 and an inner electrode 56. The expansion and contraction of each piezoelectric element 52 causes expansion and contraction of the pressure application chamber 46. Here, it is assumed that the piezoelectric constant of each piezoelectric element 52 is d33. If a driving signal is applied to one of the piezoelectric elements 52, the piezoelectric element 52 is charged and expands; on the other hand, if the charge stored in the piezoelectric element 52 is released (discharged), the piezoelectric element 52 contracts. In the base 53 and the spacer 54, a penetration hole is formed to feed ink to the liquid room 48 from the outside. This is the ink feeding hole 49 shown in FIG. 4.

The periphery of the substrate 41 and the edges of the vibration plate 42 are joined with a head frame 57 formed from an epoxy resin or PPS (Polyphenylene sulfide) by means of injection molding, and the head frame 57 and the base 53 are fixed by an adhesive agent. Further, in order to apply the driving signal to the piezoelectric element 52, an FPC (Flexible Printed Circuit) cable 58 is connected to the piezoelectric element 52 by solder, or ACF (Anisotropic Conductive Film), or by wire bonding. In the FPC cable 58, a driving circuit (driver IC) 59 is fixed to selectively apply driving signals to piezoelectric element 52.

Here, as the substrate 41, a single crystalline silicon substrate with a crystal orientation (110) is processed by the anisotropic etching using an aqueous potassium hydroxide solution (KOH) or other alkaline etching solutions, and resultantly, forming a penetration hole serving as the pressure application chamber 46, grooves serving as the ink feeding channel 47, and a penetration hole serving as the liquid room 48.

The vibration plate 42 is made of a metal plate such as nickel, and is formed by electroforming. As shown in FIG. 6, in order for the vibration plate 42 to deform easily at areas corresponding to the pressure application chambers 46, these areas are formed thin (referred to as recesses 61 below), and the areas of the vibration plate 42 for connection with the piezoelectric elements 52 are formed thick (referred to as projections 62 below). Additionally, the areas of the vibration plate 42 corresponding to the separation walls between two liquid rooms are also formed thick (projections 63 below). The flat upper surface of the vibration plate 42 is connected with the substrate 41 by an adhesive agent, and the ends of the projections 62 are connected with the head frame 57 also with an adhesive agent. Between the base 53 and the projections 63, columns 64 are formed. The columns 64 have the same shape as the piezoelectric elements 52.

The nozzle plate 43 is joined with the substrate 41. In the nozzle plate 43, nozzles 45 are formed to be 10 μm through 30 μm in diameter and at positions corresponding to respective pressure application chambers 46. For example, the nozzle plate 43 may be made from stainless, nickel or other metals, mixtures of a metal and a polyimide resin film or other resins, silicon, or mixtures of the above materials. In addition, on the surface of the nozzle plate 43 along the ink ejection direction (also referred to as "ejection surface"), a water-shedding film is formed to secure the water-shedding quality of the nozzle plate 43 with respect to ink. This water-shedding film may be formed by any well-known method, for example, plating or coating a water-shedding agent.

Next, the control section of the above inkjet recording apparatus is explained with reference to FIG. 7.

Figure 7:
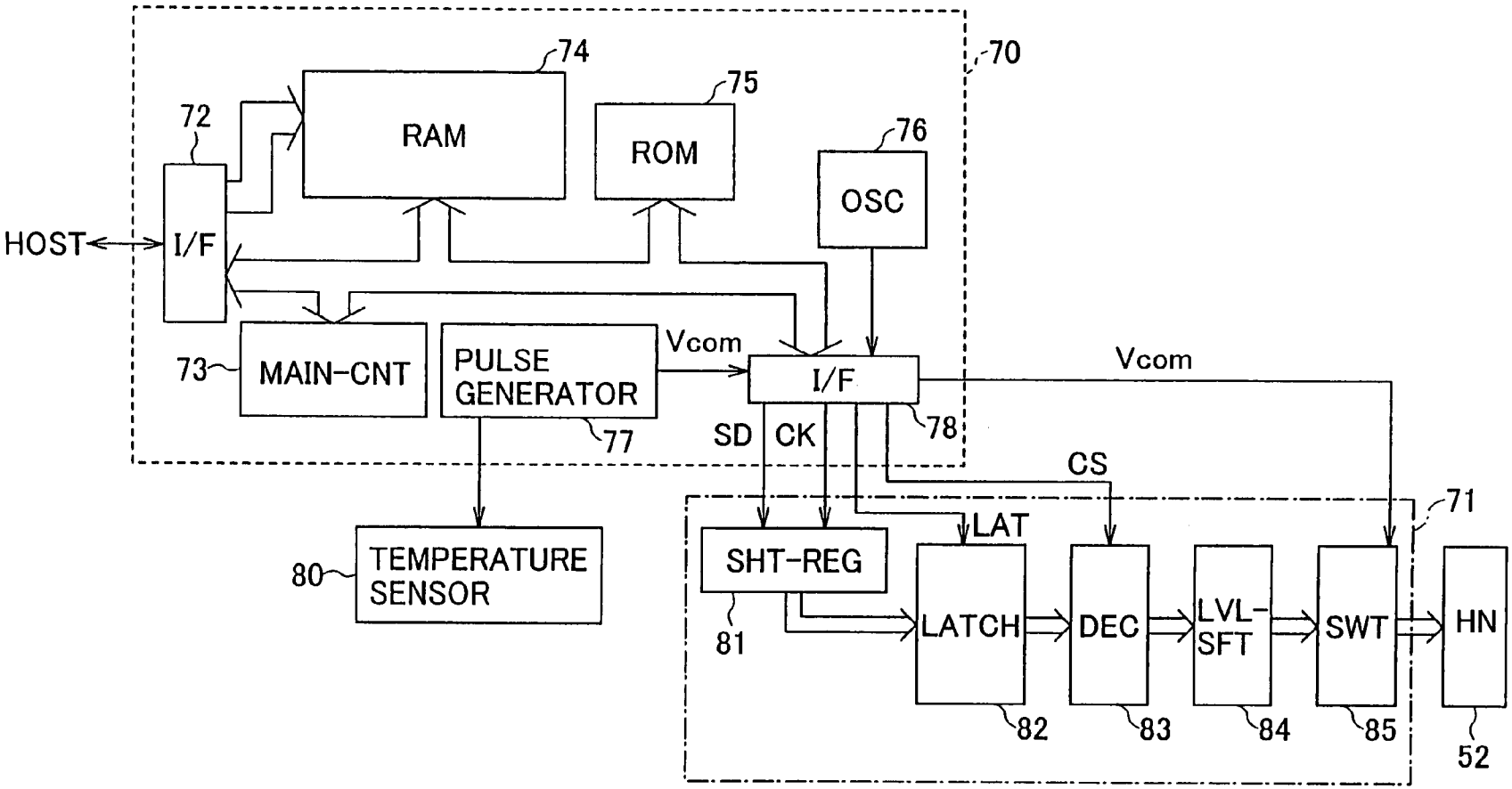
FIG. 7 is a block diagram schematically showing a control section of the inkjet recording apparatus of the present embodiment.

FIG. 7 is a block diagram showing the control section of the inkjet recording apparatus of the present embodiment.

The control section of the inkjet recording apparatus of the present embodiment is comprised of an engine controller that includes a printer controller 70 and a head driving circuit 71.

The printer controller 70 includes an interface (I/F) 72 for receiving recording data from a host computer through cables or networks, a CPU 73 for overall control of the printer controller 70, a RAM 74 in which various data are stored, a ROM 75 in which various routines for data processing are stored, an oscillation circuit (OSC) 76, a driving signal generating circuit (GNRTR) 77 that generates the driving signal Vcom to control the operation of the inkjet head 14, and an interface (I/F) 78 for transmitting the recording data expended as dot pattern data (bitmap data) and the driving signal to the head driving circuit 71.

The RAM 74 is used as buffers and working memories. The ROM 75 stores various control routines executed by the CPU 73, font data, graphic functions, and various procedures. The CPU 73 reads out the recording data in the reception buffer of the I/F 72, converts them to intermediate codes, and stores the intermediate codes in an intermediate buffer at a specified area of the RAM 74. The CPU 73 first reads out the intermediate codes from the RAM 74, and expands the intermediate codes to dot pattern data using the font data stored in the ROM 75, and then stores the dot pattern data to another specified area of the RAM 74 again.

Once the CPU 73 obtains an amount of the dot pattern data with which the inkjet head 14 can record one line on the paper 3, this amount of the dot pattern data is transmitted to the head driving circuit 71 as the serial data SD through the I/F 78 in synchronization with the clock signal CK generated by the oscillation circuit 76.

The head driving circuit 71 is built into the driver IC 59, and comprises a shift register 81 (SHT-REG) to which the serial data SD containing the clock signal CK and the recording data from the printer controller 70 are input, a latch circuit 82 (LTCH) that latches the value of the shift register 81 with the latch signal LAT from the printer controller 70, a decoder 83 (DEC) that decodes the data stored at the latch circuit 82 according to the control signal CS from the printer controller 70, a level shift circuit 84 (level shifter: LVL-SHT) that changes the level of the output of the decoder 83, and an analogue switch array (or a switch circuit) 85 that is switched ON or switched OFF by the level shifter 84.

The switch circuit 85 is for inputting the common driving signal Vcom from the driving signal generating circuit (GNRTR) 77 of the printer controller 70, and is connected with each piezoelectric element 52 corresponding to a nozzle.

Here, it is assumed that in the inkjet recording apparatus of the present embodiment, the recording data have two-bit data D0 and D1 for each channel of the inkjet head 14 in order to obtain ink droplets of four grade levels in one recording period. The serial recording data SD transmitted to the shift register 81 is first latched by the latch circuit 82, and the latched recording data SD (two-bit data D0 and D1) are decoded at the decoder 83 to which the control signal CS (including signals M0N, M1N, M2N, and M3N) is input. The levels of the decoded recording data are shifted by the level shifter 84 so as to be able to drive the switches of the switch circuit 85; for example, the levels of the decoded recording data are increased to several tens of volts. The signals of the increased levels are input to the switch circuit 85.

The driving signal Vcom from the driving signal generating circuit 77 is input to the input terminals of the switch circuit 85, and the piezoelectric elements 52 are connected to the output terminals of the switch circuit 85. Accordingly, for example, in the period when the recording data applied to the switch circuit 85 are "1", a driving pulse obtained from the driving signal Vcom is applied to the piezoelectric elements 52, and the piezoelectric elements 52 expand and contract in response to the driving pulse. In contrast, in the period when the recording data applied to the switch circuit 85 are "0", no driving pulse is output to the piezoelectric elements 52.

Figure 8:
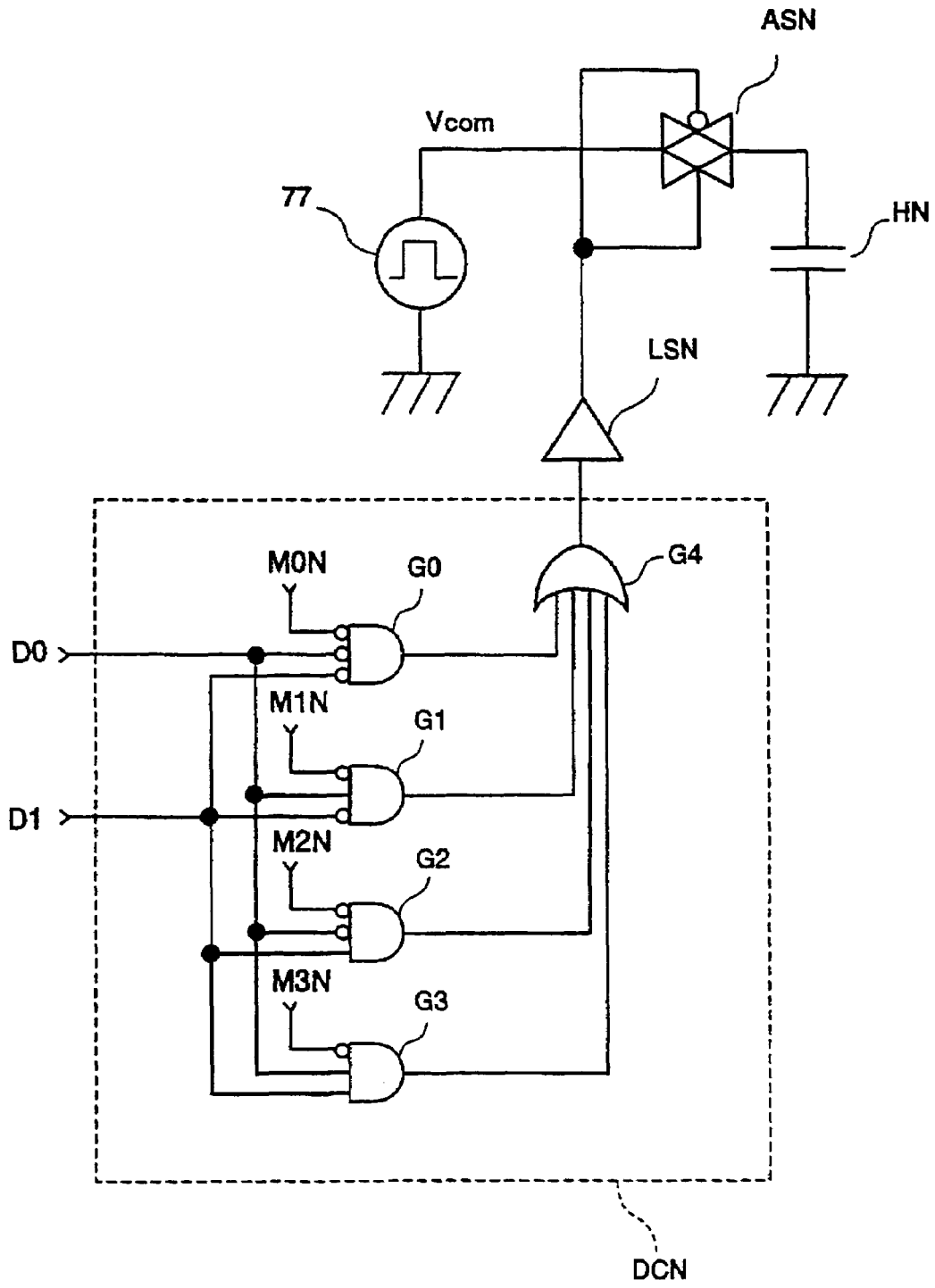
FIG. 8 is a circuit diagram of the portion subsequent to the decoders in the control section shown in FIG. 7.

FIG. 8 shows an example of a circuit subsequent to the decoder 83 in FIG. 7. Note that FIG. 8 shows only one channel of the whole circuit.

As described above, for each channel of the inkjet head 14, two-bit data D0 and D1 (referred to as "ink ejection data" below) are latched in the latch circuit 82. Here, as an example, it is assumed that when D1=1 and D0=1, an ink droplet forming a large dot is ejected, when D1=1 and D0=0, an ink droplet forming a medium dot is ejected, when D1=0 and D0=1, an ink droplet forming a small dot is ejected, and when D1=0 and D0=0, no ink droplet is ejected.

The control signal CS from the printer controller 70 is input to a decoding unit DCN of the decoder 83. The control signal CS includes gate signals M0N, M1N, M2N, and M3N defining time intervals for forming ink droplets of desired grade levels and for re-charging the piezoelectric elements 52. The same gate signals M0N, M1N, M2N, and M3N are input to all the decoding units DCN in the decoder 83.

The decoding unit DCN includes four gate circuits G0 through G3, and an OR gate circuit G4. The data D1 and D0 and the gate signals M0N, M1N, M2N, and M3N are input to the four gate circuits G0 through G3 at the same time. The outputs of the four gate circuits G0 through G3 are input to the OR gate circuit G4. The output of the decoding unit DCN is input to an analog switch ASN included in the switch circuit 85 through a level shifter LSN acting as the level shifter 84.

The driving signal Vcom is input to the analog switch ASN, and when the analog switch ASN is switched ON, a corresponding portion of the driving signal Vcom is applied to the piezoelectric element 52 as a driving signal of the inkjet head 14.

Accordingly, according to the gate signals M0N, M1N, M2N, and M3N, which are respectively related to ejection of large dots, medium dots, small dots and no ejection of dots, the corresponding analog switch ASN of the switch circuit 85 is switched ON or switched OFF.

Specifically, when the output of the decoding unit DCN is "1", the analog switch ASN is ON, and the common driving signal Vcom is applied to the piezoelectric element 52. When the output of the decoding unit DCN is "0", the analog switch ASN is OFF, and the driving signal Vcom is not applied to the piezoelectric element 52, and the output of the decoding unit DCN is in a high impedance state.

Next, with reference to FIG. 9, FIGS. 10A through 10C, and FIGS. 11A through 11I, explanations are made of the operations of the above head control device for controlling ink droplet ejection.

Figure 9:
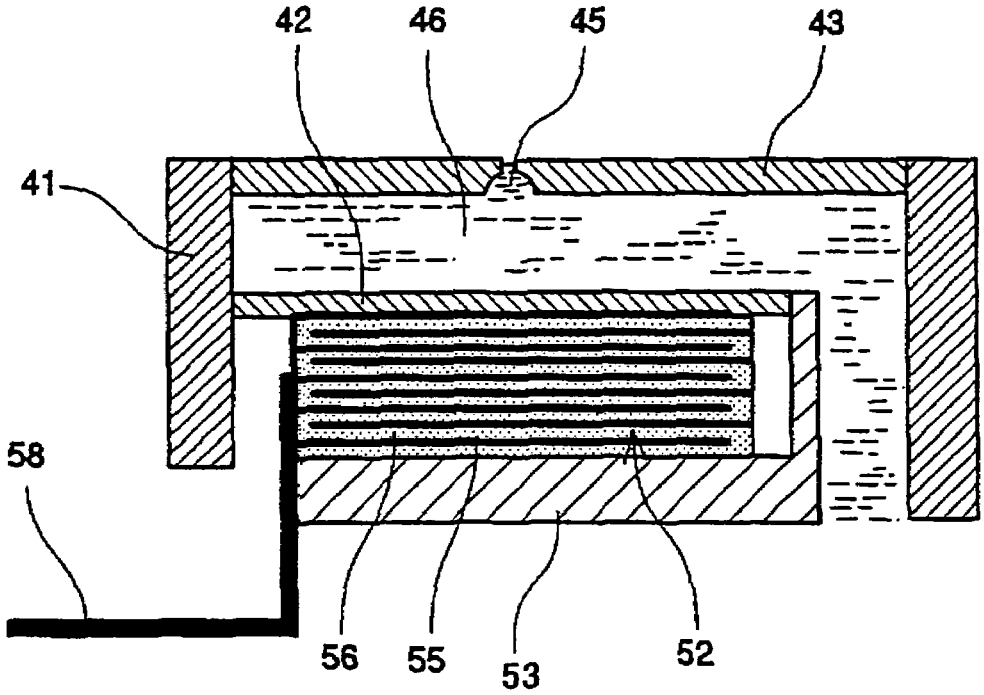
FIG. 9 is a cross-sectional view of a principal portion of the inkjet head of the present embodiment for explaining the operation thereof.
Figure 10A:
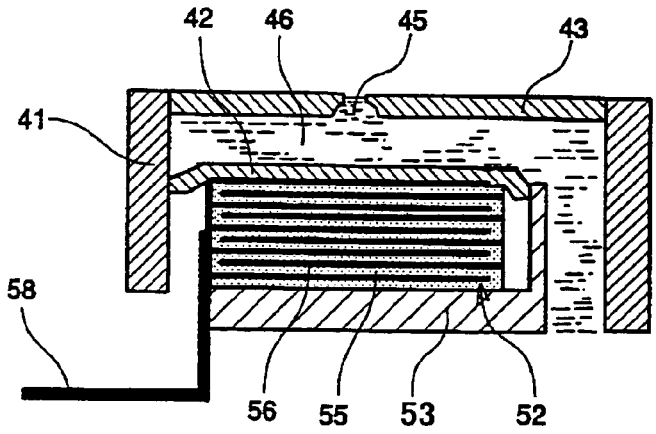
FIGS. 10A through 10C are cross-sectional views of the same portion of the inkjet head in FIG. 9 in different operation steps.
Figure 10B:
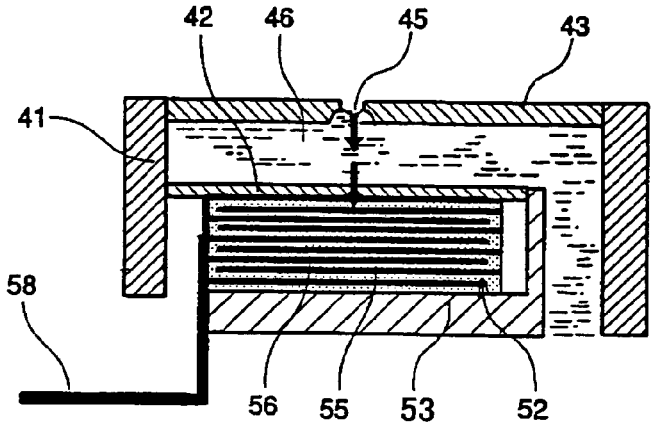
Figure 10C:
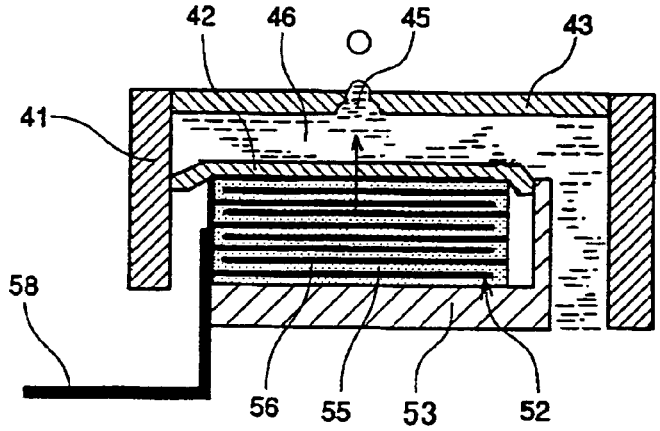

FIG. 9 is a cross-sectional view of a principal portion of the inkjet head 14 of the present embodiment; FIGS. 10A through 10C show the operation of the inkjet head 14 of the present embodiment.

First, with reference to FIG. 9 and FIGS. 10A through 10C, explanations are made of the operations of the pressure application chamber and the piezoelectric element that is operated to pull or push the side wall of the pressure application chamber. Note that although the shapes of the constituent elements of the inkjet head shown in FIG. 9 and FIGS. 10A through 10C are different from those shown in FIG. 3 through FIG. 6, the basic configurations of the inkjet head are the same, therefore, the same reference numerals are used here for the same constituent elements as shown in FIG. 3 through FIG. 6.

The inkjet head 14 shown in FIG. 9 is in a free state, that is, no driving voltage is applied to the piezoelectric element 52. From this state, if turning the power supply ON, the state of the inkjet head 14 changes to that shown in FIG. 10A. The state shown in FIG. 10A is an initial state of the inkjet head 14 during the operation thereof. In the initial state, a bias voltage is applied to the piezoelectric element 52 to charge the piezoelectric element 52. Receiving the charge, the piezoelectric element 52 expands in its thickness direction (the so-called "d33" mode: deformation in the thickness direction), and the volume of the pressure application chamber 46 decreases compared with the equilibrium state as shown in FIG. 9.

When an ink droplet is to be ejected from the nozzle 45, as shown in FIG. 10B, the pressure application chamber 46 is pulled outward first. In detail, the charge stored in the piezoelectric element 52 in the initial state is released (discharged), and the piezoelectric element 52 contracts, therefore, the volume of the pressure application chamber 46 increases. As a result, ink is pulled into the pressure application chamber 46 from an ink tank outside. In the meantime, the meniscus of the nozzle 45 is drawn inward relative to the pressure application chamber 46.

Next, as shown in FIG. 10C, a driving pulse is applied to the piezoelectric element 52 through the cable 58 to rapidly charge the piezoelectric element 52 and expand it again. Accordingly, the volume of the pressure application chamber 46 decreases drastically, ejecting an ink droplet.

In the process, a tiny droplet can be formed by controlling the expansion level of the piezoelectric element 52, for example, at steps smaller than that shown in FIG. 10A. It is possible to delicately control the formation of the tiny droplets and attain more grade levels by making the steps of changing the expansion level of the piezoelectric element 52 sufficiently small, FIGS. 11A through 11I are timing charts of signals used in the above head control device of the present embodiment for further explanations of the operations of the head control device.

Figures 11A, 11B, 11C, 11D, 11E, 11F, 11G, 11H, 11I:
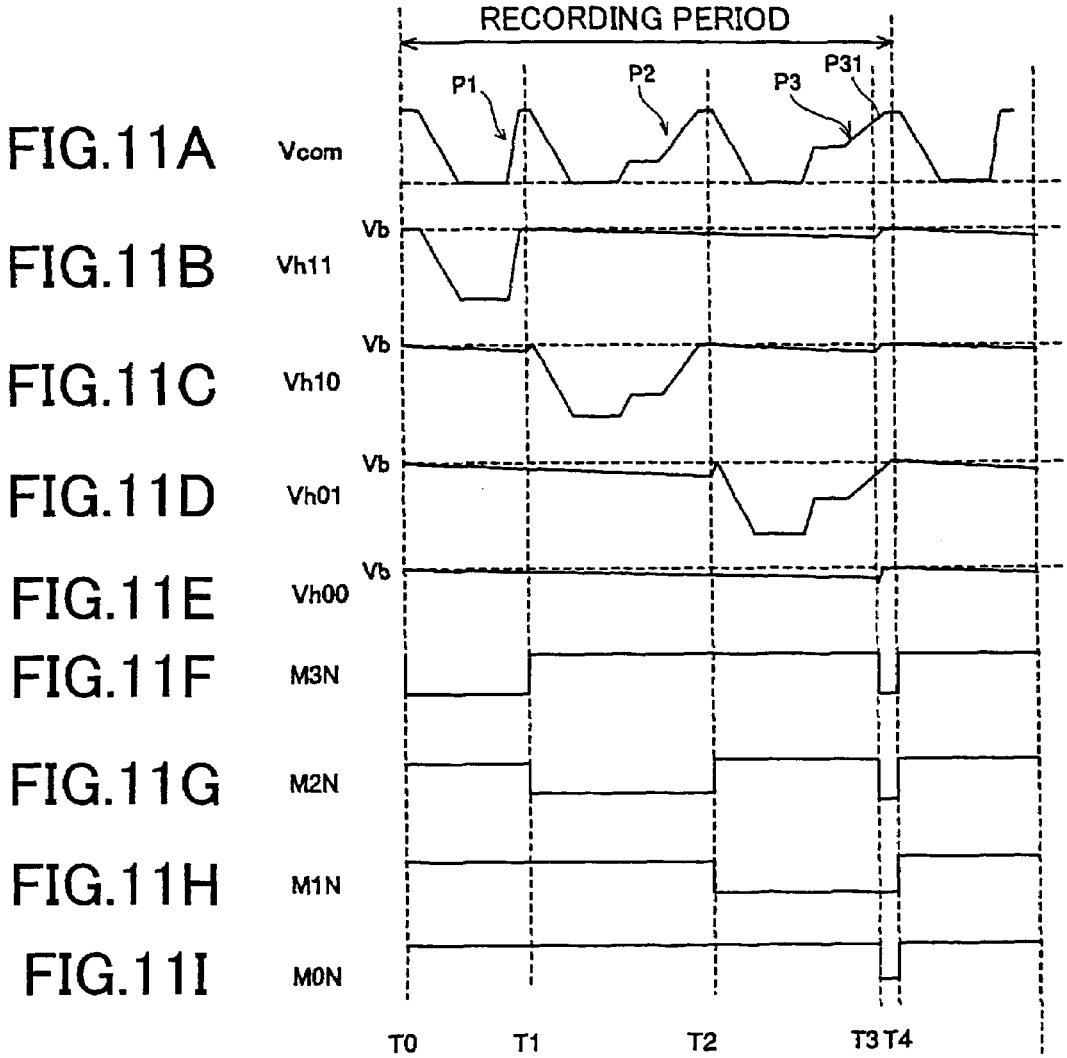
FIGS. 11A through 11I are timing charts showing the operation of the head control device of the present embodiment.
Figure 12:
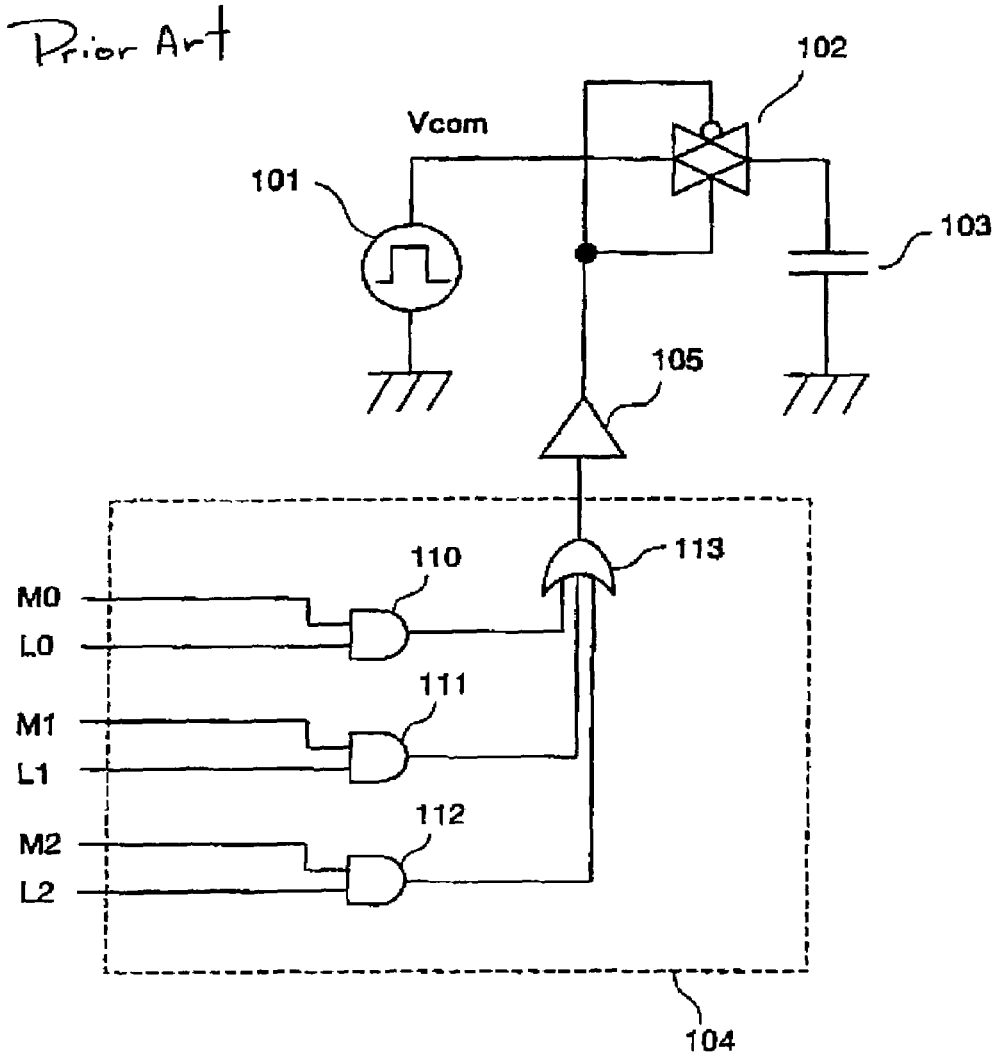
FIG. 12 shows a head control device of the related art.
Figures 13A, 13B, 13C, 13D, 13E, 13F, 13G, 13H:
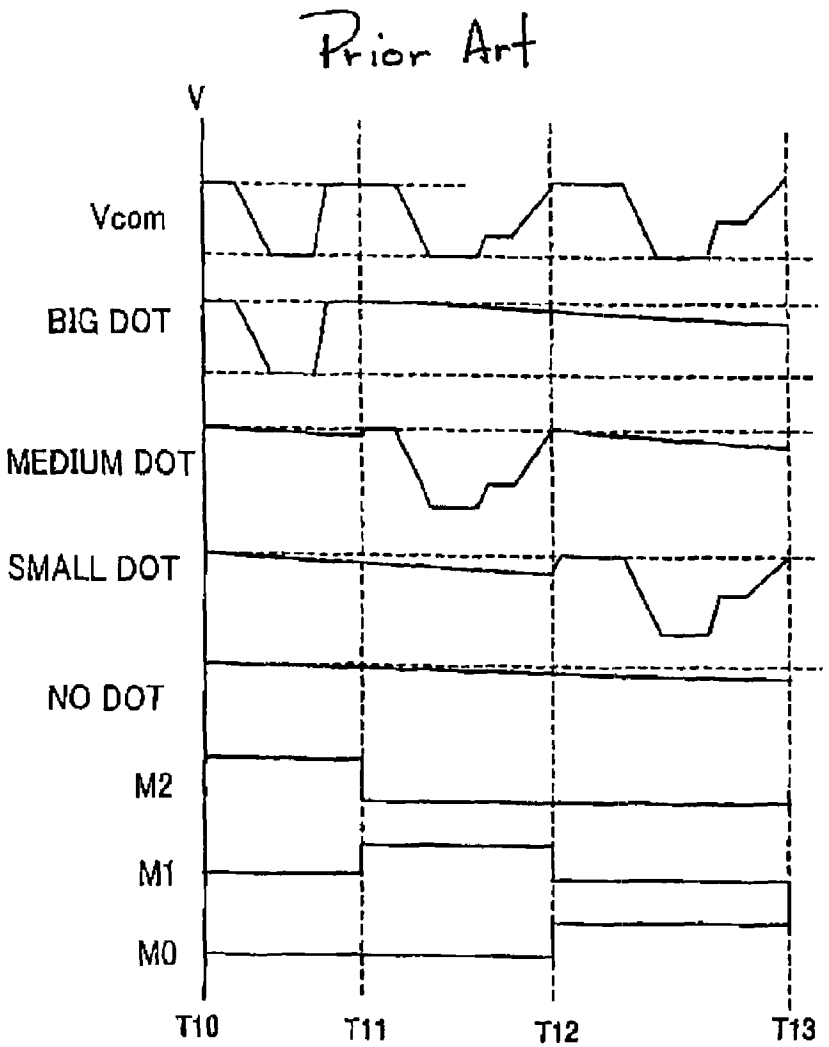
FIGS. 13A through 13H are timing charts showing the operation of the head control device of the related art.

FIG. 11A shows the waveform of the driving signals Vcom generated by the driving signal generating circuit 77. In the driving signal Vcom, there are a driving pulse P1 for forming a large dot in the period from the time T0 to the time T1, a driving pulse P2 for forming a medium dot in the period from the time T1 to time T2, and a driving pulse P3 for forming a small dot in the period from the time T2 to time T3.

In this invention, the driving pulse P3 contains a component P31 after the time T3 as shown in FIG. 11A, and the component P31 rises to a specified level Vb. Furthermore, in this invention, in the time period of the component P31, the inkjet head 14 is not operated to form ink droplets.

FIG. 11B shows a response signal Vh11 of the piezoelectric element 52 (voltage on the piezoelectric element 52) of a channel for forming a large dot, FIG. 11C shows a response signal Vh10 of the piezoelectric element 52 of a channel for forming a medium dot, FIG. 11D shows a response signal Vh01 of the piezoelectric element 52 of a channel for forming a small dot, and FIG. 11E shows a response signal Vh00 of the piezoelectric element 52 of a channel not ejecting a droplet.

FIG. 11F through 11I show the gate signals M3N, M2N, M1N, M0N input to the decoding unit DCN.

As shown in FIG. 11F through 11I, the signal M3N is "0" in the period from the time T0 to the time T1 and in the period from the time T3 to the time T4, the signal M2N is "0" in the period from the time T1 to the time T2 and in the period from the time T3 to the time T4, the signal M1N is "0" in the period from the time T2 to the time T4, and the signal M0N is "0" in the period from the time T3 to the time T4.

Next, with the above configuration, the operations of ink droplet ejection at different grade levels are explained.

In the period from T0 to T1 of the recording period shown in FIG. 11A, the analog switch ASN corresponding to the piezoelectric element 52 that causes ejection of a large ink droplet to form a large dot is switched ON. That is, the recording data SD in which D1=1, D0=1, together with the control signal CS in which M3N=0, are input to the decoding unit DCN so as to eject an ink droplet to form a large dot. Accordingly, the corresponding analog switch ASN is ON in the period from T0 to T1, and the driving pulse P1 residing in the period from T0 to T1 of the driving signal Vcom is applied to the piezoelectric element 52. Because the driving pulse P1 is applied to the piezoelectric element 52, as shown in FIG. 11B, the piezoelectric element 52 is re-charged, and the signal Vh11 (the potential of the piezoelectric element 52) increases from the level of the discharge state to the potential Vb again, ejecting an ink droplet for forming a large dot through the nozzle 45.

During this period, the analogue switches ASN are OFF in other channels that are not required to eject ink droplets for forming large dots, that is, the analog switches ASN are OFF in the channel for ejecting an ink droplet to form a medium dot, the channel for ejecting an ink droplet to form a small dot, and the channel not ejecting ink droplets in this recording period. Therefore, in these channels, the piezoelectric elements 52 start to discharge slightly. Consequently, as shown in FIGS. 11C through 11E, from the time T0, the potentials at the piezoelectric elements 52 (that is, the signals Vh10, Vh01, Vh00, respectively) start to decrease slightly from an initial potential Vb.

In the period from T1 to T2 of the recording period shown in FIG. 11A, the analog switch ASN corresponding to the piezoelectric element 52 that causes ejection of an ink droplet for forming a medium dot is switched ON. In other words, the recording data SD in which D1=1, D0=0, together with the control signal CS in which M2N=0, are input to the decoding unit DCN for ejection of an ink droplet to form a medium dot. Accordingly, the corresponding analogue switch ASN is ON in the period from T1 to T2, and the driving pulse P2 residing in the period from T1 to T2 of the driving signal Vcom is applied to the piezoelectric element 52, and an ink droplet for forming a medium dot is ejected from the nozzle 45 in this channel.

In the above step, because the driving pulse P2 is applied to the piezoelectric element 52, as shown in FIG. 11C, the piezoelectric element 52 is re-charged, and the signal Vh10 (the potential of the piezoelectric element 52) is increased from the level of the discharge state to the potential Vb again, ejecting an ink droplet.

In addition, because the analog switch ASN is OFF in the channel for ejecting an ink droplet to form a large dot, as shown in FIG. 11B, from the time T1, the potential at the piezoelectric element 52 in this channel (the signal Vh11) starts to decrease slightly from the potential Vb. Further, because the analog switch ASN remains OFF in the channel for ejecting an ink droplet to form a small dot, as shown in FIG. 11D, the piezoelectric element 52 in this channel continues to discharge, and the potential at the piezoelectric element 52 in this channel (the signal Vh01) continues to decrease. Similarly, because the analog switch ASN remains OFF in the channel not ejecting ink droplets in this recording period, as shown in FIG. 11E, the piezoelectric element 52 in this channel continues to discharge, and the potential at the piezoelectric element 52 in this channel (the signal Vh00) continues to decrease. Nevertheless, in the period from T0 to T1, because the analogue switch ASN is ON from T0 to T1 in the channel for ejecting an ink droplet to form a large dot (FIG. 11F), the amount of discharge of the piezoelectric element 52 in this channel (the signal Vh11) is relatively small compared with that in the channel for forming a small dot and the channel not forming any dots.

In the period from T2 to T3 of the recording period shown in FIG. 11A, the analog switch ASN corresponding to the piezoelectric element 52 causing ejection of an ink droplet for forming a small dot is switched ON. In other words, the recording data SD in which D1=0, D0=1, together with the control signal CS in which M1N=0, are input to the decoding unit DCN for ejection of an ink droplet for forming a small dot. Accordingly, the corresponding analog switch ASN is ON in the period from T2 to T3, and the driving pulse P3 residing in the period from T2 to T3 of the driving signal Vcom is applied to the piezoelectric element 52 in this channel, and an ink droplet for forming a small dot is ejected from the nozzle 45 in this channel.

In the above step, because the driving pulse P3 is applied to the piezoelectric element 52 that causes ejection of an ink droplet for forming a small dot, as shown in FIG. 11D, the piezoelectric element 52 is re-charged and the signal Vh01 is increased from the level of the discharge state to the potential Vb again, ejecting an ink droplet and forming a small dot.

In addition, because the analog switch ASN is OFF in the channel for ejecting an ink droplet to form a middle dot, as shown in FIG. 11C, from the time T2, the potential at the piezoelectric element 52 in this channel (the signal Vh10) starts to decrease slightly from the potential Vb. Further, because the analog switch ASN remains OFF in the channel for ejecting an ink droplet to form a large dot, as shown in FIG. 11B, the piezoelectric element 52 in this channel continues to discharge, and the potential at the piezoelectric element 52 in this channel (the signal Vh11) continues to decrease. Similarly, because the analog switch ASN remains OFF in the channel not ejecting ink droplets in this recording period, as shown in FIG. 11E, the piezoelectric element 52 in this channel continues to discharge, and the potential at the piezoelectric element 52 in this channel (the signal Vh00) continues to decrease.

In the period from T2 to T3, the analog switches ASNs are OFF in the channel forming a large dot, the channel forming a medium dot and the channel not forming any dots. For the same reason as described above, in the period from T2 to T3, because the duration of discharging of the piezoelectric elements 52 is longest in the channel not forming any dots (FIG. 11E), and shortest in the channel ejecting an ink droplet for forming a medium dot (FIG. 11C), the amount of discharge of the piezoelectric element 52 is smallest in the channel forming a medium dot, the second smallest in the channel forming a large dot, and the largest in the channel not forming any dots.

Note that the driving pulse P3 causing ejection of an ink droplet for forming a small dot increases until the time T3; it does not rise to the potential Vb. That is, the driving pulse P3 causes ejection of an ink droplet for forming a small dot, but in this ejection, the piezoelectric element 52 is not sufficiently expanded. The piezoelectric element 52 remains in this state after the time T3.

Then, in the period from T3 to T4 of the recording period shown in FIG. 11A, the gate signals M3N, M2N, M1N, and M0N are all "0" (M3N=M2N=M1N=M0N=0), so the analog switches ASN are ON in all channels despite the values of the recording data D1 and D0, and therefore, the piezoelectric elements 52 in all channels are re-charged, and the piezoelectric element 52 in the channel for forming a small dot is charged following the driving pulse P3.

The above re-charging in the period from the time T3 to the time T4 is performed by using the signal P31, which is a component of the driving pulse P3 subsequent to the time T3, at which an ink droplet for forming a small dot is ejected.

In addition, as shown in FIG. 11B through FIG. 11E, the level of the signal component P31 at the time T3 is slightly lower than the potential Vb, and the signal component P31 rises from this level to the potential Vb.

At the time T3, the amounts of discharge of the piezoelectric elements 52 in different channels for forming dots of different sizes are slightly different, hence, the potentials of the piezoelectric elements 52 in different channels are slightly different at time T3. From these potentials, the piezoelectric elements 52 in different channels are re-charged to the potential Vb in the period from T3 to T4.

Due to the re-charging, the piezoelectric elements 52 in different channels expand and tend to eject ink from the corresponding pressure application chambers. However, in the period from T3 to T4, the changes of the potentials of the piezoelectric elements 52 in different channels are small, and do not cause ink ejection.

Summarizing the above description, the piezoelectric element is re-charged by the signal P31 that rises from a slightly lower level to the target potential Vb, but not by a flat level at the target potential Vb, thus re-charging of the piezoelectric element can be started earlier than when using a flat level Vb. Consequently, the duration of re-charging by the flat level Vb becomes short.

Since the change of the potential of the piezoelectric element during the re-charging is small, the re-charging does not influence the next ink ejection operation.

In addition, according to the present invention, a plurality of piezoelectric elements can be re-charged at the same time, so the associated circuits can be made simple.

Further, since the signal P31 is applied to the piezoelectric element at time T3 after the ink droplet ejection operation induced by the driving pulse P3, the re-charging by the signal P31 does not influence the ink droplet ejection operation, and reduces mistaken ink ejection due to re-charging.

Furthermore, since the signal P31 is included in one recording period (from the time T0 to the time T4), it is not necessary to allocate an additional time period for the re-charging signal, so it is possible to increase the speed of image formation and improve image quality.

If the time period elapsed after the analog switch is switched OFF and the amount of discharge of the piezoelectric elements after the time period elapsed are known (assuming the piezoelectric elements have been charged to the target potential Vb, that is, the initial potentials of the piezoelectric elements are Vb), and if it can be assured that mistaken ejections will not occur in other channels from these information elements, it is sufficient to set only the gate signals M0N and M1N to "0" in the period from T3 to T4 so as to re-charge only the piezoelectric elements in the channels not ejecting ink droplets.

By doing this, the discharging states of the piezoelectric elements in all channels last for no more than two periods, and this allows a more stable recording operation. In addition, the current generated during re-charging may be distributed in a number of periods, and this further reduces the complication of the control signals.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

For example, in the above embodiment, an inkjet recording apparatus including an inkjet head ejecting ink droplets is used as an example to describe the image recording apparatus of the present invention. The present invention is not limited to this; it is applicable to any image recording apparatus including liquid droplet ejection devices ejecting droplets of any other kind of liquid, for example, a liquid droplet ejection head for ejecting droplets of liquid resist for use of patterning in a semiconductor fabrication process, and a liquid droplet ejection head for ejecting droplets of DNA samples.

Summarizing the effect of the invention, according to the head control device of the present invention, it is possible to re-charge an electromechanical transducing element using a driving pulse without providing an additional re-charging time in a recording period, and this makes it possible to make the time of re-charging the electromechanical transducing element short, and improve image quality and image formation speed.

This patent application is based on Japanese priority patent application No. 2002-182284 filed on Jun. 24, 2002, the entire contents of which are hereby incorporated by reference.

The invention claimed is:

1. A head control device that applies a driving signal to an electromechanical transducing element to change a shape of the electromechanical transducing element to change a volume of a liquid droplet ejection chamber filled with a liquid for ejecting a liquid droplet through a nozzle in communication with the liquid droplet ejection chamber, the head control device comprising:

a head driving unit that generates the driving signal including a plurality of cycles of a plurality of driving pulses, and selects and applies at least a portion of one of the driving pulses to the electromechanical transducing element, each of the driving pulses having a contracting portion changing from a first level to a second level for discharging the electromechanical transducing element from a first potential corresponding to the first level to a second potential corresponding to the second level to contract the electromechanical transducing element from a first shape to a second shape, and an expanding portion changing from the second level to a third level to charge the electromechanical transducing element to a third potential corresponding to the third level to expand the shape of the electromechanical transducing element to eject the liquid droplet; and a re-charging portion, in at least one driving pulse in each cycle and subsequent to the expanding portion, changing from the third level to the first level to recharge the electromechanical transducing element to the first potential, without affecting ejection of ink droplets in the expanding portion, wherein the electromechanical transducing element to be recharged by application of the re-charging portion corresponds to a nozzle not ejecting a liquid droplet in the cycle, and wherein the recharging portion is a first instance of a change from the third level to the first level of the driving signal applied to the electromechanical transducing element in the cycle, and wherein each of the driving pulses is a corresponding portion of the driving signal which starts at the first level, then varies from the first level, and then ends at a first instance of return of the driving signal to the first level.

2. The head control device of claim 1, wherein the re-charging portion of said at least one driving pulse in each cycle re-charges the electromechanical transducing element to a level suitable for ejecting another liquid droplet.

3. The head control device as claimed in claim 1, wherein the re-charging portion of the driving signal from the head control device is applied to a plurality of electromechanical transducing elements corresponding to respective nozzles not ejecting a liquid droplet in the cycle, to recharge the plurality of electromechanical transducing elements at the same time.

4. The head control device as claimed in claim 1, further comprising a control circuit configured to generate a control signal indicating time intervals for forming ink droplets of desired grade levels and for re-charging the electromechanical transducing element, wherein said re-charging portion is applied in the time interval for re-charging the electromechanical transducing element.

5. The head control device as claimed in claim 1, wherein the re-charging portion of the driving signal from the head control device is applied to one or more other electromechanical transducing elements corresponding to respective nozzles not ejecting a liquid droplet in the cycle, to recharge said one or more other electromechanical transducing elements to recharge at the same time that the electromechanical transducing element is re-charged.

6. The head control device of claim 1, wherein the re-charging portion in the cycle of the driving signal is applied to each of a plurality of electromechanical transducing elements.

7. An image recording apparatus, comprising:

a liquid droplet ejection head including a plurality of liquid droplet ejection chambers each filled with a liquid and communicating with a corresponding nozzle, and a plurality of electromechanical transducing elements in correspondence with the liquid droplet ejection chambers; and a head control device that applies a driving signal to the electromechanical transducing elements to change shapes of the electromechanical transducing elements to change volumes of the corresponding liquid droplet ejection chambers for ejecting liquid droplets through the corresponding nozzles to record an image, the head control device comprising:

a head driving unit that generates the driving signal including a plurality of cycles of a plurality of driving pulses, and selects and applies at least a portion of one of the driving pulses to one of the electromechanical transducing elements to change the shape of the electromechanical transducing element for ejecting the liquid droplet, each of the driving pulses having a contracting portion changing from a first level to a second level for discharging the electromechanical transducing element from a first potential corresponding to the first level to a second potential corresponding to the second level to contract the electromechanical transducing element from a first shape to a second shape, and an expanding portion changing from the second level to a third level for to charge the electromechanical transducing element to a third potential corresponding to the third level to expand the shape of the electromechanical transducing element to eject the liquid droplet; and a re-charging portion, in at least one driving pulse in each cycle and subsequent to the expanding portion, changing from the third level to the first level to recharge the electromechanical transducing element to the first potential, without affecting ejection of ink droplets in the expanding portion, wherein the electromechanical transducing element to be recharged by application of the re-charging portion corresponds to a nozzle not ejecting a liquid droplet in the cycle, and wherein said recharging portion is a first instance of a change from the third level to the first level of the driving signal applied to the electromechanical transducing element in said cycle, and wherein each of the driving pulses is a corresponding portion of the driving signal which starts at the first level, then varies from the first level, and then ends at a first instance of return of the driving signal to the first level.

8. The image recording apparatus as claimed in claim 7, wherein the head driving unit selects the re-charging portion of said at least one driving pulse in each cycle to re-charge the plurality of electromechanical transducing elements at the same time.

9. The image recording apparatus as claimed in claim 7, wherein a plurality of the electromechanical transducing elements are recharged at the same time.

10. The image recording apparatus of claim 7, wherein the re-charging portion in the cycle of the driving signal is applied to each of the plurality of electromechanical transducing elements.

* * * * *